US005474271A

United States Patent [19]

Raymond

[11] Patent Number: 5,474,271

[45] Date of Patent: Dec. 12, 1995

[54] PORTABLE COMPRESSOR STAND

[76] Inventor: Peter T. Raymond, 167 Windmill Rd., Conowingo, Md. 21918

[21] Appl. No.: 164,968

[22] Filed: Dec. 10, 1993

[51] Int. Cl.[6] ..... F16M 11/00

[52] U.S. Cl. ..... 248/237; 182/45; 248/148

[58] Field of Search ..... 248/237, 148, 248/238, 236; 182/45

[56] References Cited

U.S. PATENT DOCUMENTS

| | | | |
|---|---|---|---|
| 84,595 | 12/1868 | Doren | 248/237 |
| 612,256 | 11/1898 | Mattson | 248/237 X |
| 1,267,056 | 5/1918 | Chappuis | 248/237 X |
| 1,363,864 | 12/1920 | Grush | 248/237 X |
| 2,275,014 | 3/1942 | Hahler | 248/237 |
| 2,299,323 | 10/1942 | Hetky | 248/237 |
| 2,496,556 | 2/1950 | Nelson | 248/237 |
| 2,623,794 | 12/1952 | Osten | 182/45 |
| 5,193,773 | 3/1993 | Middleton | 248/148 |
| 5,211,411 | 5/1993 | Oleksiuk | 248/237 X |

FOREIGN PATENT DOCUMENTS

| | | | |
|---|---|---|---|
| 2292089 | 6/1976 | France | 182/45 |
| 227748 | 9/1985 | Netherlands | 182/45 |

*Primary Examiner*—Karen J. Chotkowski

[57] ABSTRACT

A new and improved portable stand for roofs having a rigid and planar platform. A pivoting foot is rotatably coupled to the planar platform. A fixing device for securing the orientation of the pivoting foot is relative to the platform. An adjustment device is rotatably coupled to the platform such that the adjustment device and pivoting foot define a pivotable V-shaped configuration adapted to straddle and lay flush against the peak of a roof. An adjustable mechanism is rotatably coupled to the platform and adapted to be coupled with the adjustment device to place the platform in an essentially horizontal position. A handle is coupled to the stand for carrying the stand from one location to another when the platform, pivoting foot, fixing means and adjustment means are oriented to define a portable configuration.

2 Claims, 4 Drawing Sheets

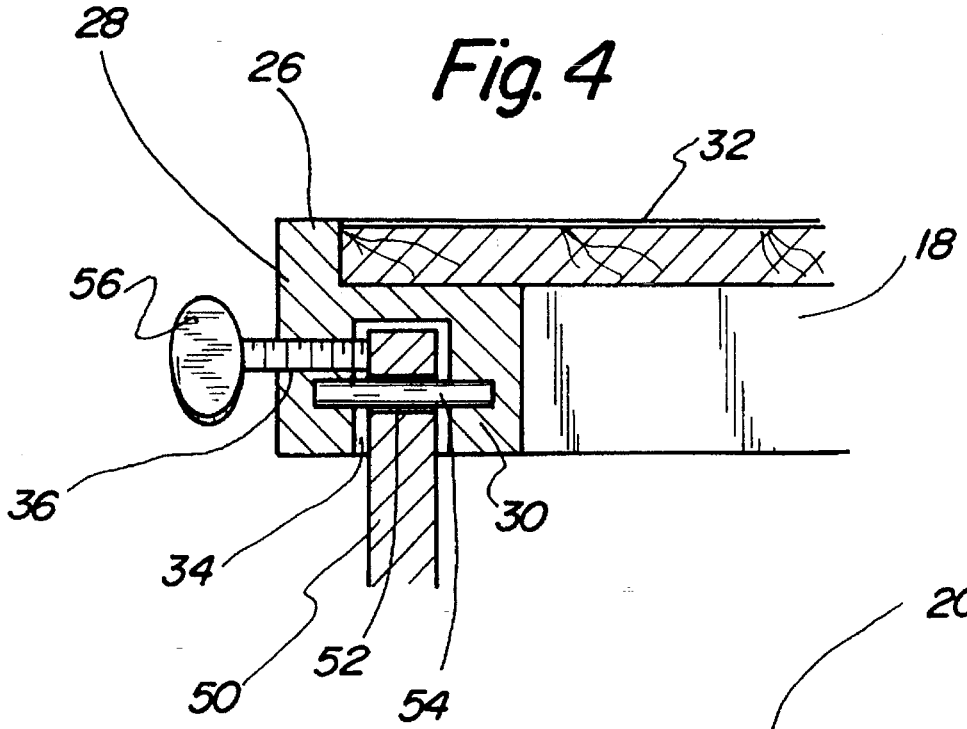
Fig. 4
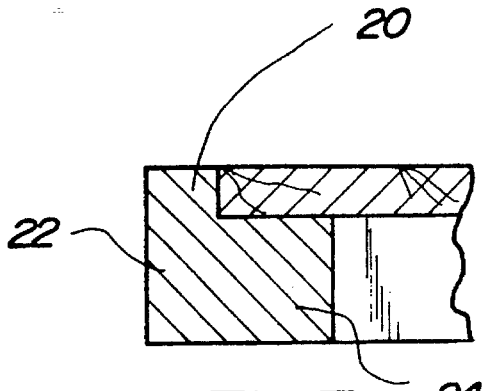
Fig. 3
Fig. 5
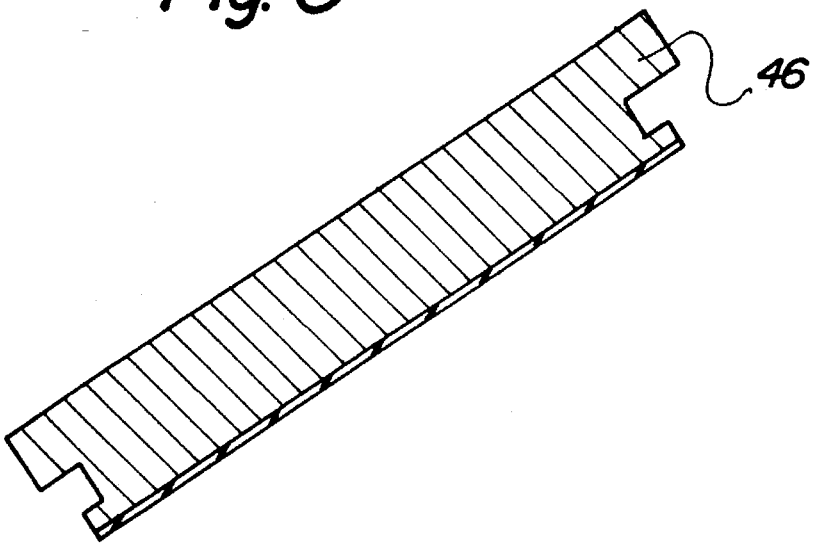

PORTABLE COMPRESSOR STAND

BACKGROUND OF THE INVENTION

1. Field of the Invention

The present invention relates to a portable roof stand and more particularly pertains to a portable roof stand for providing a support for use on a roof.

2. Description of the Prior Art

The use of roof stands is known in the prior art. More specifically, roof stands heretofore devised and utilized for the purpose of providing a support for use on a roof are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,450,935 to Gustavus and U.S. Pat. No. 5,004,072 to Launer disclose support platforms for use on a roof.

Other patents that illustrate components generally related to the invention are U.S. Pat. No. 4,724,646 to Meyers, U.S. Pat. No. 5,054,576 to Glynn, and U.S. Pat. No. 5,148,890 to Sipe.

While these devices fulfill their respective, particular objective and requirements, the aforementioned patents do not describe a portable roof stand that is simple, lightweight, and portable in design, is adapted to be positioned on the side or at the peak of a roof, and is provided with a mechanism for adjusting the platform thereon to an essentially horizontal position.

In this respect, the portable roof stand according to the present invention substantially departs from the conventional concepts and designs of the prior art, and in doing so provides an apparatus primarily developed for the purpose of providing a support for use on a roof.

Therefore, it can be appreciated that there exists a continuing need for new and improved portable roof stand which can be used for providing a support for use on a roof. In this regard, the present invention substantially fulfills this need.

SUMMARY OF THE INVENTION

In the view of the foregoing disadvantages inherent in the known types of roof stands now present in the prior art, the present invention provides an improved portable roof stand. As such, the general purpose of the present invention, which will be described subsequently in greater detail, is to provide a new and improved portable roof stand and method which has all the advantages of the prior art and none of the disadvantages.

To attain this, the present invention essentially comprises four rigid and elongated rails coupled together end to end in a rectangular configuration to define a frame having a pair of oppositely opposed first side rails, a pair of oppositely opposed second side rails, and a space between the pairs of first and second side rails, each first side rail having a j-shaped configuration with a long leg coupled to a short leg, each second side rail having an h-shaped configuration with a long leg, a short leg, and a cross leg therebetween, each second side rail further having a cavity disposed between the long leg and short leg for receiving an axle therein, a threaded screw hole disposed on the long leg and extending to the cavity, and a downwardly extending pivot mount coupled near each end thereof and adjacent to each first side rail, a rigid and rectangular plate positioned within the space of the frame in contact with the legs of the first side rails and the long leg and cross leg of the second side rails to define a platform, an elongated and planar pivoting foot having an upper surface and a lower surface, the lower surface having a layer of non-skid rubber disposed thereon for holding the foot in a fixed position, a pair of rigid and elongated short arms, each short arm having a first end and a second end, the first end having a pivot hole disposed therethrough, the second end connected to the top surface of the pivot foot, a pair of axles, each axle disposed through the pivot hole of each short arm, the axle and first end of the short arm disposed within the cavity of each side rail to pivotally couple the pivoting foot to the frame, a pair of thumb screws, each thumb screw disposed through the threaded screw hole of each second side rail to lock the short arms in position, whereby fixing the orientation of the pivoting foot relative to the platform, a pair of rigid and elongated long arms, each long arm having a first end, a second end, and a plurality of upward extending slots disposed thereon, the first end of the long arm pivotally connected to a pivot mount located adjacent to the pivoting foot such that each long arm and each short arm pair define a pivotable v-shaped configuration adapted to straddle and lay flush against the peak of a roof, an H-shaped bracing member further comprising a pair of rigid and elongated bracing legs with a beam disposed therebetween, each bracing leg having a first end and a second send, the first end pivotally connected to a pivot mount located remote from the pivot foot, the second end having a dowel extension formed thereon adapted to be inserted into an appropriate slot of a long arm, both bracing legs combining to place the platform in an essentially horizontal position, and a handle coupled to the frame adjacent to the pivoting foot for carrying the stand from one location to another when the pivoting foot, long arms, and bracing legs have been pivoted to align with the platform to define a portable configuration.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable roof stand which has all the advantages of the prior art roof stands and none of the disadvantages.

It is another object of the present invention to provide a new and improved portable roof stand which may be easily and efficiently manufactured and marketed.

It is a further object of the present invention to provide a new and improved portable roof stand which is of durable and reliable construction.

An even further object of the present invention is to provide a new and improved portable roof stand which is susceptible of a low cost of manufacture with regard to both materials and labor, and which accordingly is then susceptible of low prices of sale to the consuming public, thereby making such a portable roof stand economically available to the buying public.

Still yet another object of the present invention is to provide a new and improved portable roof stand which provides in the apparatuses and methods of the prior art some of the advantages thereof, while simultaneously overcoming some of the disadvantages normally associated therewith.

Even still another object of the present invention is to provide a new and improved portable roof stand designed to serve as a stand for an air compressor as it is used on a rooftop to power pneumatic nail guns.

Even still another object of the present invention is to provide a new and improved portable roof stand for supporting personnel working on a roof or equipment used when working on a roof.

Even still another object of the present invention is to provide a new and improved portable roof stand that is lightweight and features a platform with an adjustable mount.

Even still another object of the present invention is to provide a new and improved portable roof stand that may be configured to be carried from one location to another by hand in a portable manner.

Even still another object of the present invention is to provide a new and improved portable roof stand that may be positioned and moved on the roof through the use of a plurality of wheels coupled thereto.

Lastly, it is an object of the present invention to provide a new improved portable roof stand comprising a rigid and planar platform, a pivoting foot rotatably coupled to the planar platform, fixing means for securing the orientation of the pivoting foot relative to the platform, adjustment means rotatably coupled to the platform such that the adjustment means and pivoting foot define a pivotable v-shaped configuration adapted to straddle and lay flush against the peak of a roof, adjustable means rotatably coupled to the platform and adapted to be coupled with the adjustment means to place the platform in an essentially horizontal position, and a handle coupled to the stand for carrying the stand from one location to another when the platform, pivoting foot, fixing means, adjustment means, are oriented to define a portable configuration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an schematic view of the connection between a first side rail and the plate of the portable roof stand.

FIG. 4 is an schematic view of the connection between a short arm, a second side rail, and the plate of the portable roof stand.

FIG. 5 is a view of the rubber pad that is coupled to the pivoting foot.

The same reference numerals refer to the same parts through the various Figures.

DESCRIPTION OF THE PREFERRED EMBODIMENT

Figure 1:
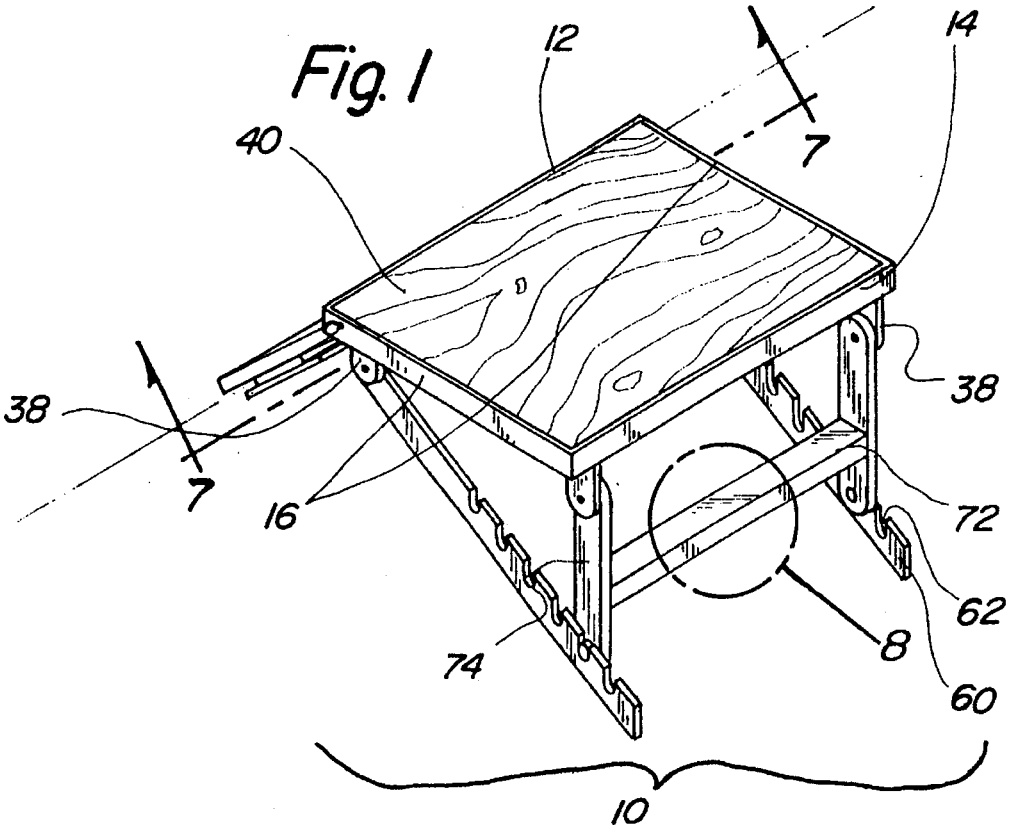
FIG. 1 is a perspective view of the preferred embodiment of the portable roof stand constructed in accordance with the principles of the present invention.
Figure 2:
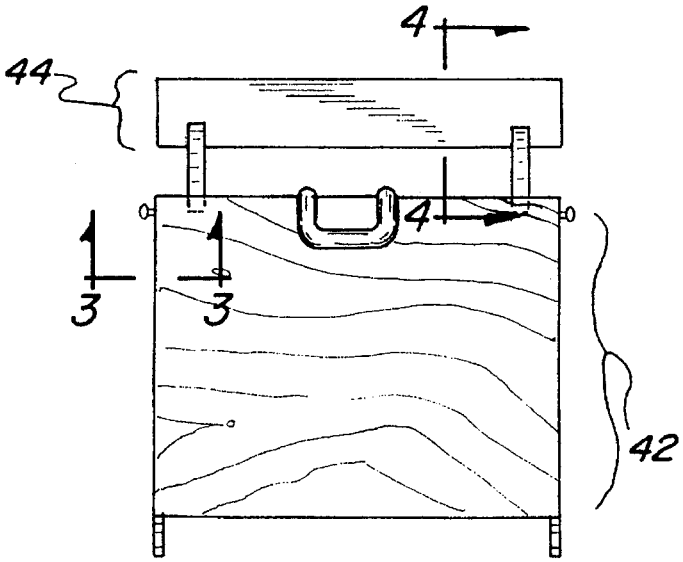
FIG. 2 is a plan view of the portable roof stand shown in FIG. 1.

With reference now to the drawings, and in particular, to FIG. 1 thereof, the preferred embodiment of the new and improved portable roof stand embodying the principles and concepts of the present invention and generally designated by the reference number 10 will be described.

More specifically, it will be noted in the various Figures that the portable stand 10 for roofs comprises four rigid and elongated rails coupled together end to end in a rectangular configuration to define a frame 12. The frame has a pair of oppositely opposed first side rails 14 and a pair of oppositely opposed second side rails 16. A space 18 is defined between the pairs of first and second side rails. Each first side rail 20 has a j-shaped configuration with a long leg 22 coupled to a short leg 24. Each second side rail 26 has an h-shaped configuration with a long leg 28, a short leg 30, and a cross leg 32 therebetween. Each second side rail further has a cavity 34 disposed between the long leg and short leg for receiving an axle therein. A threaded screw hole 36 is disposed on the long leg and extends to the cavity. A downwardly extending pivot mount 38 is coupled near each end of each second side rail. Each mount point is also located adjacent to an end of each first side rail.

A rigid and rectangular plate 40 is positioned within the space 18 of the frame 12 in contact with the legs of the first side rails 14 and the long leg and cross leg of the second side rails 16 to define a platform 42. The platform is adapted to support equipment on a roof such as an air compressor to power pneumatic air guns for roofing. The stand includes an elongated and planar pivoting foot 44 having an upper surface and a lower surface. The lower surface has a layer of non-skid rubber 46 disposed thereon for holding the foot in a fixed position on a roof, thus providing stability to the stand.

The stand includes a pair of rigid and elongated short arms. Each short 50 arm has a first end and a second end. The first end has a pivot hole 52 disposed therethrough. The second end is connected to the top surface of the pivoting foot 44. The stand includes a pair of axles. Each axle 54 is disposed through the pivot hole 52 of each short arm. The axle and first end of the short arm are disposed within the cavity 34 of each second side rail to pivotally couple the pivoting foot to the frame 12. The stand includes a pair of thumb screws. Each thumb screw 56 is disposed through the threaded screw hole 36 of each second side rail to lock a short arm 50 in position, whereby fixing the orientation of the pivoting foot 44 relative to the platform.

The stand includes a pair of rigid and elongated long arms. Each long arm 60 has a first end, a second end, and a plurality of upward extending slots 62 disposed thereon. The first end of each long arm is pivotally connected to a pivot mount 38 located adjacent to the pivoting foot 44. Each long arm and each short arm 50 pair define a pivotable v-shaped configuration adapted to straddle and lay flush against the peak or side of a roof. This configuration also enables the stand to be used on a variety of pitched or non-pitched roofs.

The stand includes an H-shaped bracing member further comprising a pair of rigid and elongated bracing legs 70 with a beam 72 disposed therebetween. Each bracing leg has a first end and a second send. The first end is pivotally connected to a pivot mount 38 located remote from the pivot foot. The second end has a dowel extension 74 formed thereon adapted to be inserted into an appropriate slot 62 of a long arm, with both bracing legs combining to place the platform in an essentially horizontal or other suitable support position.

A handle 80 is coupled to the frame 12 adjacent to the pivoting foot for carrying the stand from one location to another when the pivoting foot, long arms, and bracing legs have been pivoted to align with the platform to define a portable configuration.

Figure 6:
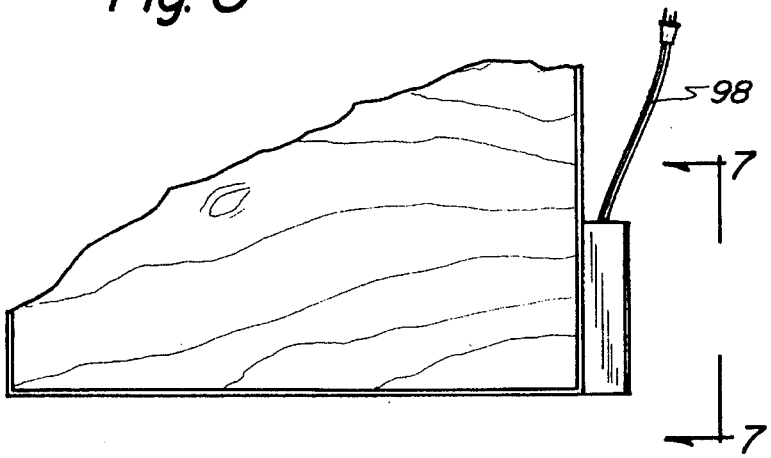
FIG. 6 is a plan view of the power strip and platform of a an alternate embodiment of the invention.
Figure 7:
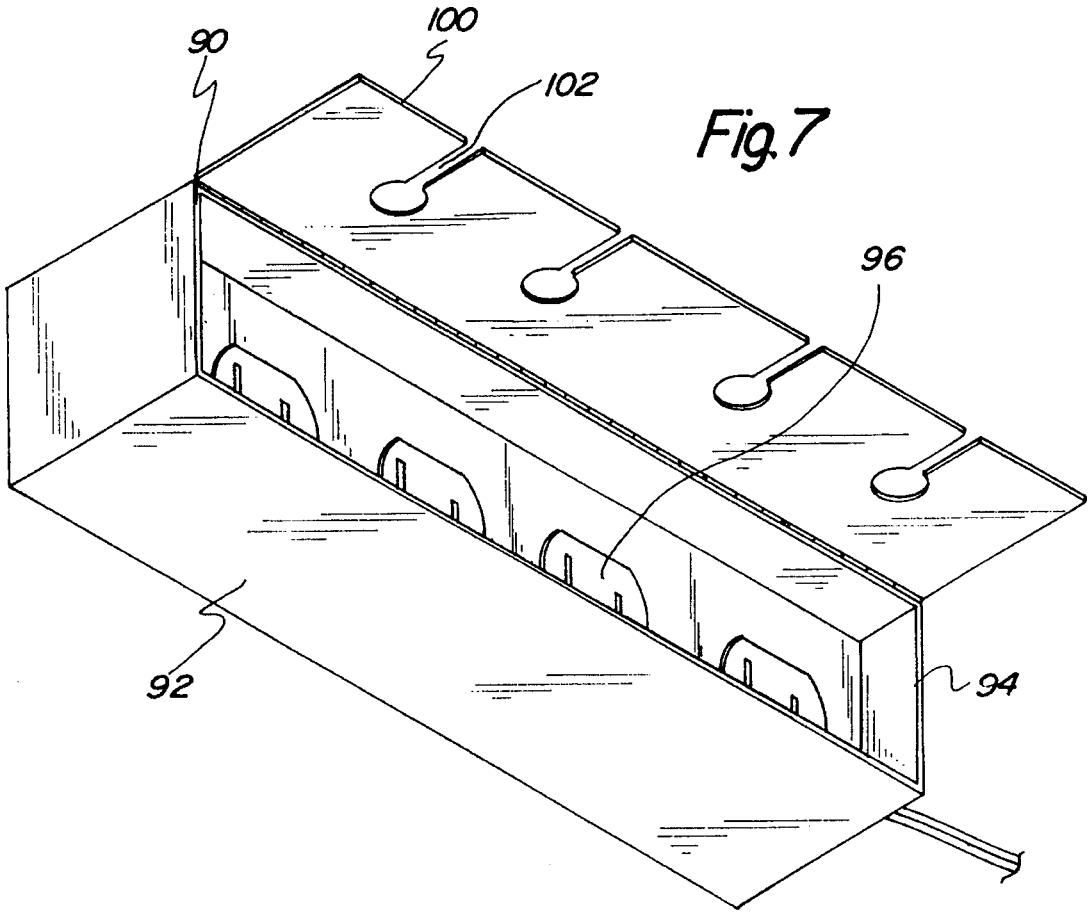
FIG. 7 is a perspective view of the power strip of the alternate embodiment of FIG. 5.

A second embodiment of the device is shown in FIG. 6 and FIG. 7 and includes substantially all of the features of the first embodiment further including a power strip 90 coupled to the platform. The power strip includes a container 92 having an opening 94 disposed thereon. A plurality of electrical plug adapters 96 is disposed within the container. A power cord 98 is coupled to the plug adapters for supplying energy thereto. A cover 100 is rotatably coupled to the container. The cover has a plurality of slots 102 disposed thereon with each slot adapted to receive a power plug from an electrical appliance. The cover is adapted to shield the connection between a power plug and a plug adapter when placed over the opening.

Figure 8:
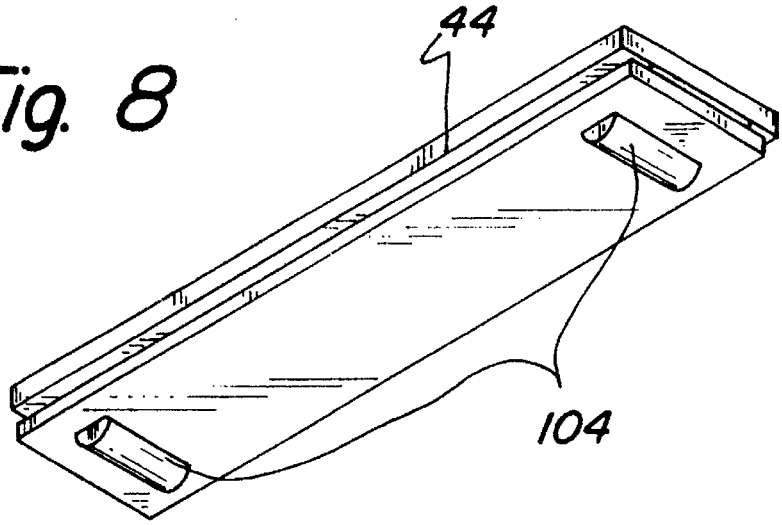
FIG. 8 is a perspective view of the pivoting foot of yet another alternate embodiment of the present invention.

A third embodiment of the device is shown in FIG. 8 and includes substantially all of the features of the first embodiment further it includes a plurality of rotatable wheels 104 coupled to the pivoting foot 44 to enable the pivoting foot to be rolled down the peak of the roof when positioned for use.

Figure 9:
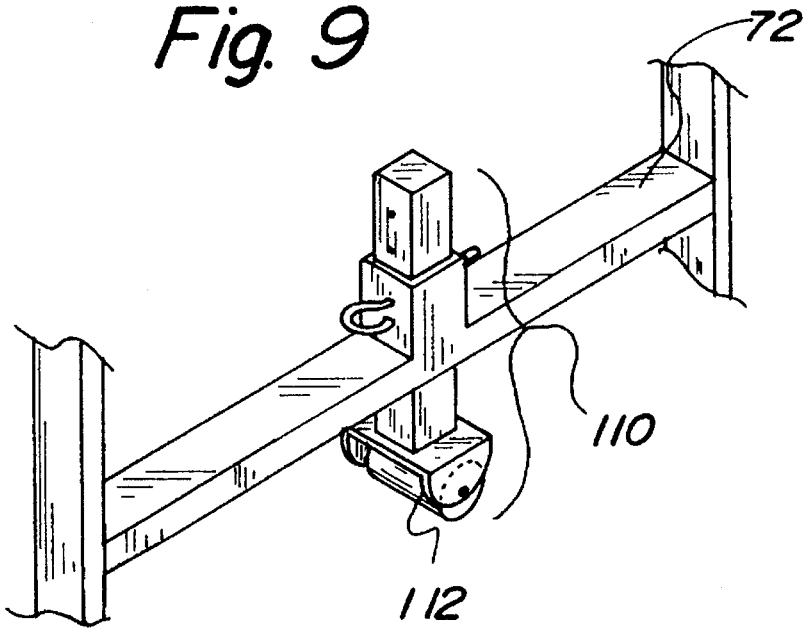
FIG. 9 is a perspective view of the transport member of yet another alternate embodiment of the present invention.

A fourth embodiment of the device is shown in FIG. 9 and includes substantially all of the features of the first embodiment. It further includes a transport member 110. The transport member includes a wheel 112 and an elongated and upright traversing member 114 coupled between the beam 72 and the wheel 112. The traversing member is adapted to extend the wheel to a position whereby the stand may rest thereon and be transported along the roof from one location to another.

The portable compressor stand of the present invention, as the name suggests, is designed to serve as a stand for an air compressor as it is used on a rooftop to power pneumatic nail guns. It is made of lightweight aluminum and features a twenty-four inch square platform and an adjustable mount. A pivot-mounted pair of adjacent legs are affixed to the lower side at one end of the platform. The shorter pair of these two sets each have a pivoting foot which is faced with non-skid rubber, and the longer pair have a series of semi-circular slots cut along the length of the upper surface.

Two additional legs, also pivot-mounted, are affixed to the other end of the platform, and each of these legs has dowel-like extensions which are sized to snugly fit into he aforementioned slots. In use, the adjacent legs at one end of the platform are manipulated in a scissors-like fashion to lay flush against the surface of the roof as straddling the peak of the roof. The shorter legs are adjusted first and locked in position using a thumb screw, and the longer legs are free to rotate and make contact with the roof on the other side of the peak. It is then a simple matter to engage the dowel extensions into the appropriate set of slots in the longer legs so that the third set of legs are vertical and the platform horizontal.

The result is a stable platform which straddles the peak of the roof to serve as a stable support for the compressor. The hammering of nails by hand is a practice which is virtually obsolete in commercial practice. The present invention addresses and solves the problem of how to best secure the power source in the proximity of the work.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved portable stand for roofs comprising:

four rigid and elongated rails coupled together end to end in a rectangular configuration to define a frame having a pair of oppositely opposed first side rails, a pair of oppositely opposed second side rails, and a space between the pairs of first and second side rails, each first side rail having a j-shaped configuration with a long leg coupled to a short leg, each second side rail having an h-shaped configuration with a long leg, a short leg, and a cross leg therebetween, each second side rail further having a cavity disposed between the long leg and short leg for receiving an axle therein, a threaded screw hole disposed on the long leg and extending to the cavity, and a downwardly extending pivot mount coupled near each end thereof and adjacent to each first side rail;

a rigid and rectangular plate positioned within the space of the frame in contact with the legs of the first side rails and the long leg and cross leg of the second side rails to define a platform;

an elongated and planar pivoting foot having an upper surface and a lower surface, the lower surface having a layer of non-skid rubber disposed thereon for holding the foot in a fixed position;

a pair of rigid and elongated short arms, each short arm having a first end and a second end, the first end having a pivot hole disposed therethrough, the second end connected to the top surface of the pivot foot;

a pair of axles, each axle disposed through the pivot hole of each short arm, the axle and first end of the short arm disposed within the cavity of each second side rail to pivotally couple the pivoting foot to the frame;

a pair of thumb screws, each thumb screw disposed through the threaded screw hole of each second side rail to lock a short arm in position, whereby fixing the orientation of the pivoting foot relative to the platform;

a pair of rigid and elongated long arms, each long arm having a first end, a second end, and a plurality of upward extending slots disposed thereon, the first end of the long arm pivotally connected to a pivot mount located adjacent to the pivoting foot such that each long arm and each short arm pair define a pivotable v-shaped configuration adapted to straddle and lay flush against the peak of a roof;

an H-shaped bracing member further comprising a pair of rigid and elongated bracing legs with a beam disposed therebetween, each bracing leg having a first end and a second send, the first end pivotally connected to a pivot mount located remote from the pivot foot, the second end having a dowel extension formed thereon adapted to be inserted into an appropriate slot of a long arm, both bracing legs combining to place the platform in an essentially horizontal position; and a handle coupled to the frame adjacent to the pivoting foot for carrying the stand from one location to another when the pivoting foot, long arms, and bracing legs have been pivoted to align with the platform to define a portable configuration.

2. A new and improved portable stand for roofs comprising:

a rigid and planar platform;

a pivoting foot rotatably coupled to the planar platform;

fixing means for securing the orientation of the pivoting foot relative to the platform;

adjustment means rotatably coupled to the platform such that the adjustment means and pivoting foot define a pivotable V-shaped configuration adapted to straddle and lay flush against the peak of a roof;

adjustable means rotatably coupled to the platform and adapted to be coupled with the adjustment means to place the platform in an essentially horizontal position;

a handle coupled to the stand for carrying the stand from one location to another when the platform, pivoting foot, fixing means and adjustment means are oriented to define a portable configuration; and a transport member with a wheel and an elongated and upright traversing member coupled between the adjustable means and the wheel, the traversing member adapted to extend the wheel to a position whereby the stand may rest thereon and be transported from one location to another.

* * * * *